US009982875B2

(12) United States Patent
Stevens

(10) Patent No.: US 9,982,875 B2
(45) Date of Patent: May 29, 2018

(54) MODULAR LIGHTING, DETECTION AND CONTROL SYSTEM FOR AN INDUSTRIAL CONSTRUCTION OR VEHICLE SERVICE CONSTRUCTION, AND SUSPENSION RAIL AND SYSTEM MODULES THEREFORE

(71) Applicant: TriLED cvba, Ham (BE)

(72) Inventor: Hans Stevens, Ham (BE)

(73) Assignee: TriLED cvba, Ham (BE)

( * ) Notice: Subject to any disclaimer, the term of this patent is extended or adjusted under 35 U.S.C. 154(b) by 87 days.

(21) Appl. No.: 15/124,341

(22) PCT Filed: Mar. 13, 2015

(86) PCT No.: PCT/EP2015/055310
§ 371 (c)(1),
(2) Date: Sep. 7, 2016

(87) PCT Pub. No.: WO2015/136080
PCT Pub. Date: Sep. 17, 2015

(65) Prior Publication Data

US 2017/0016600 A1 Jan. 19, 2017

(30) Foreign Application Priority Data

Mar. 13, 2014 (NL) ..... 2012429

(51) Int. Cl.
*F21V 21/03* (2006.01)
*F21S 8/04* (2006.01)
(Continued)

(52) U.S. Cl.
CPC ..... *F21V 21/03* (2013.01); *F21S 8/046* (2013.01); *F21V 21/35* (2013.01); *F21V 29/76* (2015.01);
(Continued)

(58) Field of Classification Search
CPC ..... F21V 21/35; F21V 21/03; F21V 23/001; F21S 8/046; H01R 25/147
See application file for complete search history.

(56) References Cited

U.S. PATENT DOCUMENTS 5,117,340 A * 5/1992 Schafer ..... F21S 8/04 362/148
2005/0146899 A1 7/2005 Joseph et al.
2009/0168423 A1 7/2009 Miller

FOREIGN PATENT DOCUMENTS

EP 0 734 108 9/1996
FR 2 788 106 7/2000
WO WO 2008/099306 8/2008

* cited by examiner

*Primary Examiner* — Karabi Guharay
(74) *Attorney, Agent, or Firm* — Pillsbury Winthrop Shaw Pittman, LLP

(57) ABSTRACT

The invention is directed at a modular lighting, detection and control system (1) for an industrial construction or a vehicle service construction comprising an assembly of one or more suspension rails (3) and one or more system modules (7), wherein the suspension rails (3) are arranged for receiving the system modules (7), and the system modules (7) are arranged for mounting thereof on the suspension rails (3) for suspending therefrom, and wherein the system is arranged conveying electric signals to and/or from the modules (7) via the suspension rails (3), said electric signals including a power signal for powering the system modules (7), wherein the system further comprises a low voltage power supply unit for providing the power signal, the power signal being a low voltage electrical power signal, and wherein for conveying the electric signals the suspension rails (3) comprise one or more conductor sections (12,13,14,15), wherein the conductor sections (12,13,14,15) are formed of a conductive material substantially comprising aluminum.

15 Claims, 13 Drawing Sheets

(51) Int. Cl.

| | |
|---|---|
| ***F21V 21/35*** | (2006.01) |
| ***H01R 25/14*** | (2006.01) |
| ***F21V 29/76*** | (2015.01) |
| *F21Y 105/10* | (2016.01) |
| *F21Y 115/10* | (2016.01) |
| *F21V 23/00* | (2015.01) |
| *F21V 23/02* | (2006.01) |
| *F21V 23/04* | (2006.01) |
| *F21V 31/00* | (2006.01) |
| *H05B 37/02* | (2006.01) |

(52) U.S. Cl.

CPC ..... *H01R 25/142* (2013.01); *F21V 23/001* (2013.01); *F21V 23/02* (2013.01); *F21V 23/0471* (2013.01); *F21V 29/763* (2015.01); *F21V 31/005* (2013.01); *F21Y 2105/10* (2016.08); *F21Y 2115/10* (2016.08); *H01R 25/147* (2013.01); *H05B 37/0263* (2013.01)

MODULAR LIGHTING, DETECTION AND CONTROL SYSTEM FOR AN INDUSTRIAL CONSTRUCTION OR VEHICLE SERVICE CONSTRUCTION, AND SUSPENSION RAIL AND SYSTEM MODULES THEREFORE

CROSS-REFERENCE TO RELATED APPLICATIONS

This is the U.S. National Stage of PCT/EP2015/055310, filed Mar. 13, 2015, which in turn claims priority to Netherlands Application No. 2012429, filed Mar. 13, 2014, the entire contents of all applications are incorporated herein by reference in their entireties.

FIELD OF THE INVENTION

The present invention is directed at a modular lighting, detection and control system for a vehicle service construction comprising an assembly of one or more suspension rails and one or more system modules, wherein the suspension rails are arranged for receiving the system modules, and the system modules are arranged for mounting thereof on the suspension rails for suspending therefrom. The invention is further directed at a suspension rail and at a system module for use in such a modular lighting, detection and control system.

BACKGROUND

In industrial service constructions, e.g. vehicle service constructions such as parking garage buildings, lighting, detection and control systems are typically applied such as to facilitate building services. These services, for a parking garage, for example include lighting, signaling, free parking space detection, and the like. For an industrial building, such as a large storage facility or distribution center, the construction is to be equipped mainly with lighting, and additionally often with different kinds of building services. Requirements for such systems include robustness and efficient space and power usage, sometimes combined with versatility. The required services may be implemented as system modules, which are preferably part of a single lighting, detection and control system.

Advantageously, the system modules of such a lighting, detection and control system are operated at low voltage levels (e.g. below 75V DC or 50V AC) at which levels the safety regulations are more lenient. Lighting under these conditions (e.g. <75V DC) may be provided for example with light emitting diode (LED) based armatures. LED's provide a robust low maintenance lighting solution.

To guarantee sufficient power everywhere in the system, the system may use high voltage levels requiring secure cabling. Alternatively or in addition, multiple power supplies reduce the distances between the supply and the powered modules. This causes such systems often to be bulky such as to give room to large amounts of cabling. As a result, the systems are heavy, take large amounts of space, and are difficult to install.

SUMMARY OF THE INVENTION

It is an object of the present invention to provide a modular lighting, detection and control system for an industrial construction or a vehicle service construction, which is safe, easy to install, and compact to allow efficient space usage.

To this end, there is provided herewith a modular lighting, detection and control system for an industrial construction or a vehicle service construction comprising an assembly of one or more suspension rails and one or more system modules, wherein the suspension rails are arranged for receiving the system modules, and the system modules are arranged for mounting thereof on the suspension rails for suspending therefrom, and wherein the system is arranged conveying electric signals to and/or from the system modules via the suspension rails, said electric signals including a power signal for powering the system modules wherein the system further comprises a low voltage power supply unit for providing the power signal, the power signal being a low voltage electrical power signal, and wherein for conveying the electric signals the suspension rails comprise one or more conductor sections, wherein the conductor sections are formed of a conductive material substantially comprising aluminum; and wherein the conductive material comprises a surface layer of anodized aluminum.

The present invention is particularly directed at lighting, detection and control systems for use in industrial constructions and vehicle service constructions. The term 'vehicle service construction' as used herein is to be interpreted as a construction to be particularly used for providing a function to vehicles, such as offering therein a vehicle related service or facilitating transportation, typically for professional use. For example, a vehicle service construction could be a large parking garage, a maintenance garage, a tunnel or an open tunnel or semi tunnel, a fly-over or overpass. An industrial construction should be interpreted as including storage facilities, manufacturing constructions, chemical plants, distribution centers, and similar professional and industrial facilities that are to be equipped with standard building services such as lighting, signaling and signposting, user interfaces, safety and service detectors, and the like.

The system of the present invention operates at low voltage levels, e.g. <75V DC. These voltage levels are relatively safe to allow lenient safety regulations. In particular, since in many of the constructions and facilities mentioned above the system is exposed to humid climates, and may be easily accessible to vermin and other external factors, the use of low voltages is advantageous from a safety perspective.

At low voltage levels, however, currents must be relatively large such as to provide the required electrical power for powering a number of lighting and other modules. This is in particular the case when the distance between the most remote system module and the power supply module is large, and/or where the number of system modules is large. To allow sufficiently large currents between the power supply and the most remote system module, whilst minimizing dissipated energy in the conductor (or at least keeping it within limits), the resistance of the conductor must be low. The conductor thus should ideally have a large cross section.

The present invention is based on the insight that under these conditions, an aluminum conductor, or conductor being made of a conductive material consisting of mainly (e.g. at least 80% by weight) aluminum, allows the conductor to comprise a sufficiently large cross section such as to yield a low overall resistance between the power supply and each of the modules. Since aluminum is a low weight metal, it can be handled with ease providing an easy to install system. Moreover, aluminum is a relatively cheap material as compared to other materials with similar electrical properties.

Copper, for example, is per unit of volume approximately three times as heavy as aluminum, but copper is a slightly better conductor (approximately 1.7 times as good as aluminum (at 20° C.: Al: $\sigma=3.50*10^7$ S/M; Cu: $\sigma=5.96*10^7$ S/m). In comparison, a system comprising copper rails or rails with copper conductor sections operating at the same low voltage levels would be approximately twice as heavy. Since the price of copper per weight unit is approximately four times that of aluminum, the conductive parts of such a system would be approximately eight times as expensive.

As follows from the above, the modular lighting, detection and control system of the present invention which is placed on aluminum conductor sections is advantageous, in particular where the system operates at low voltage levels. When it comes to robustness of the system, it must be said that aluminum may be more prone to corrosion than copper. Therefore, in accordance with the invention, the conductive material of which the conductor sections of the suspension rails are made may be made of anodized aluminum. Anodized aluminum comprises a protective and electrically insulating surface layer. This surface layer protects the interior aluminum conductor material against corrosion, and prevents an electric shock to occur when the surface of the conductive material is touched. In particular at the low voltage levels of the lighting, detection and control system of the present invention, the use of anodized aluminum is effective in obtaining the desired advantages at low cost. As will be appreciated to achieve the same level of protection with a copper conductor, the conductor must be covered with an insulating layer (such as the cladding of an electrical cable) or must be enclosed by the protective rail.

Moreover, in accordance with a further embodiment, one or more of the conductor sections may be integrally formed with the suspension rail, and the suspension rail itself may be formed with the same conductive material. Whether or not the conductor section is integrally formed therewith, the use of aluminum for providing the suspension rail already provides advantages from the prospective of being low cost and lightweight.

In accordance with a further embodiment of the present invention, the system modules of the modular lighting, detection and control system of the present invention, for mounting of those modules on at least one of the suspension rails, include a mounting electrode. The mounting electrode is formed of a conductive material and includes a pointed tip that can be forced through the layer of anodized aluminum into the interior aluminum of the conductor section. This will establish a conductive connection with the conductor section of the suspension rail.

It is in particular recognized that a conductive connection between a conductor section of the suspension rail and the module of the embodiment mentioned hereinabove, advantageously is protected against corrosion. In particular, since the bare aluminum will easily corrode, a conductive connection between the system module of the embodiment mentioned hereinabove and the conductor section may deteriorate overtime. Due to the corroding aluminum, the resistance of the conductive connection may increase, and its conductivity may decrease. Lighting modules being powered by electrical signals conveyed via the conductor sections may therefore fail overtime when the resistance of the conductive connection becomes too large due to corrosion. Before this will happen in those embodiments wherein also an electric data signal is included in the electric signals conveyed, the data signal that is also provided via the conductor sections may fail, since the relatively weak and alternating (binary) data signal is more prone to the increasing resistance of the conductive connection than the electrical power signal.

In view of the above, in accordance with a further embodiment, the mounting electrode further includes a seal for sealing the conductive connection which is established between the pointed tip and the conductor section. The seal provides a further barrier that prevents the conductive connection from being in contact with the relatively humid exterior climate. Advantageously, in accordance with a further embodiment, the seal may be a flexible seal which surrounds the pointed tip, and which may be compressed to provide a desired sealing function when the pointed tip is forced into the conductor section through the anodized aluminum layer.

For forcing the pointed tip through the anodized layer of aluminum, the system module in accordance with an embodiment of the present invention may comprise a mounting member which cooperates with the mounting electrode. In accordance with various embodiments, the mounting electrodes may comprise at least one of the group comprising: a screw for screwing the mounting electrode with the pointed tip into the anodized layer; a pin cooperating with a spring for forcing the tip through the anodized layer by spring force of the spring, or a pin cooperating with a clamp mechanism on the mounting member.

The suspension rails in accordance with a further embodiment of the present invention may comprise multiple conductor sections. These conductor sections may be electrically insulated from each other for conveying one or more of the electric signals separate from each other. For example, the electric data signals may be separated from the power signals for powering the modules. Moreover, the suspension rails may include conductor sections for carrying different data signals separate from each other, and may also comprise multiple conductor sections for carrying the power signals. In accordance with a further embodiment, the data signals and power signals may be conveyed over the same conductor sections. The system may for example make use of powerline communication wherein the data signals are super imposed over the power signals.

The system may further comprise a data communication module for providing and/or receiving the electric data signals. This data communication model may be arranged for supporting at least one data communication protocol of a group comprising: a fieldbus type protocol, such as Profinet protocol or EtherCAT protocol; a power line communication type protocol, such as DC-LIN or DC-BUS or European Installation Bus (EIB) or digital addressable lighting interface (DALI). The data communication module may be integrated in a control module.

The system modules in accordance with an embodiment of the present invention may include one or more of a group comprising a lighting module comprising a lighting armature, a control module for controlling one or more other system modules, an object detection module such as a vehicle detection module for detecting the presence of a vehicle, or a motion detection module.

In accordance with a further aspect of the present invention there is provided a suspension rail being arranged for receiving system modules in use suspending therefrom, the rail comprising one or more conductor sections, wherein the conductor sections are formed of a conductive material substantially comprising aluminum.

In accordance with a third aspect of the present invention as provided a system module for use in a modular lighting, detection and control system in accordance with a first aspect, wherein the system module is arranged for mounting thereof on a suspension rail of the system for suspending therefrom, wherein for mounting thereof on at least one of the suspension rail the system module includes a mounting electrode, said mounting electrode being formed of a conductive material and including a pointed tip for forcing said pointed tip through the layer of anodized aluminum such as to establish a conductive connection with at least one of said conductor sections of the rail.

BRIEF DESCRIPTION OF THE DRAWINGS

The invention will further be elucidated by description of some specific embodiments thereof, making reference to the attached drawings. The detailed description provides examples of possible implementations of the invention, but is not to be regarded as describing the only embodiments falling under the scope. The scope of the invention is defined in the claims, and the description is to be regarded as illustrative without being restrictive on the invention. In the drawings:

DETAILED DESCRIPTION

Figure 1:
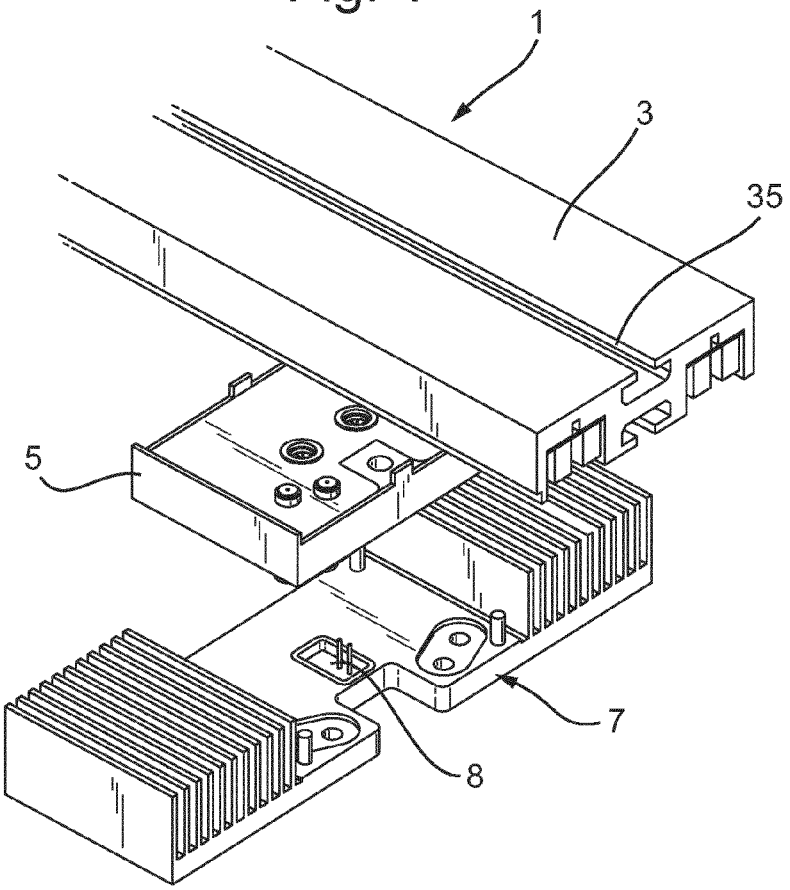
FIG. 1 illustrates various modules of a modular lighting, detection and control system of the present invention.

In FIG. 1, various parts of a modular lighting, detection and control system 1 in accordance with the present invention are illustrated. FIG. 1 illustrates a suspension rail 3, a mounting member 5, and a lighting module 7. To mount the lighting module 7 onto the suspension rail 3 of the system 1, the mounting member 5 comprises mounting electrodes connectable with conductor sections of the suspension rail 3. The mounting member 5 is mounted onto the suspension rail 3, and the lighting module 7 may conveniently be connected to the mounting member 5. The power signals and data signals are exchanged between the mounting member 5 and the lighting module 7 via input/output connection 8 of the module 7.

Figure 2:
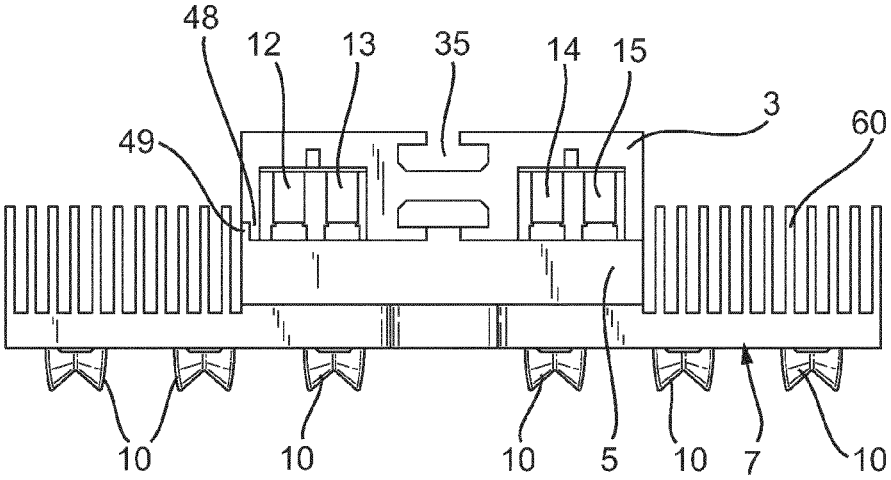
FIG. 2 illustrates a connection between the lighting module and a suspension rail in cross section.

FIG. 2 illustrates a cross section of lighting module 7 being connected by means of the mounting member 5 to the suspension rail 3. The suspension rail 3 comprises conductor sections 12, 13, 14 and 15. In the embodiment illustrated, conductor sections 12 and 13 convey the power signals for powering the various modules connected to the system. The conductor sections 14 and 15 convey the data signals for controlling the various modules in the system 1. The lighting module 7 comprises a plurality of light emitting diodes (LED's) 10. As indicated in FIG. 2, once assembled, the suspension rail 3, the mounting member 5 and the lighting module 7 have a thickness of only 50 mm. Cooling ribs 60 extend sideways relative to the height dimension of the system. The modular lighting, detection and control system of the present invention is therefore highly efficient in space usage. The suspension rail 3 will be connected to the ceiling of a building (such as a parking garage) by means of the slot 35 which may correspond to a suitably shaped bolt that may be fixed to the ceiling. Once the suspension rail 3 is attached to the ceiling, modules may easily be added to the system 1 by mounting the mounting members 5 to the rail 3, and fixing the respective system modules (such as lighting module 7) to the mounting members 5.

Figure 3A:
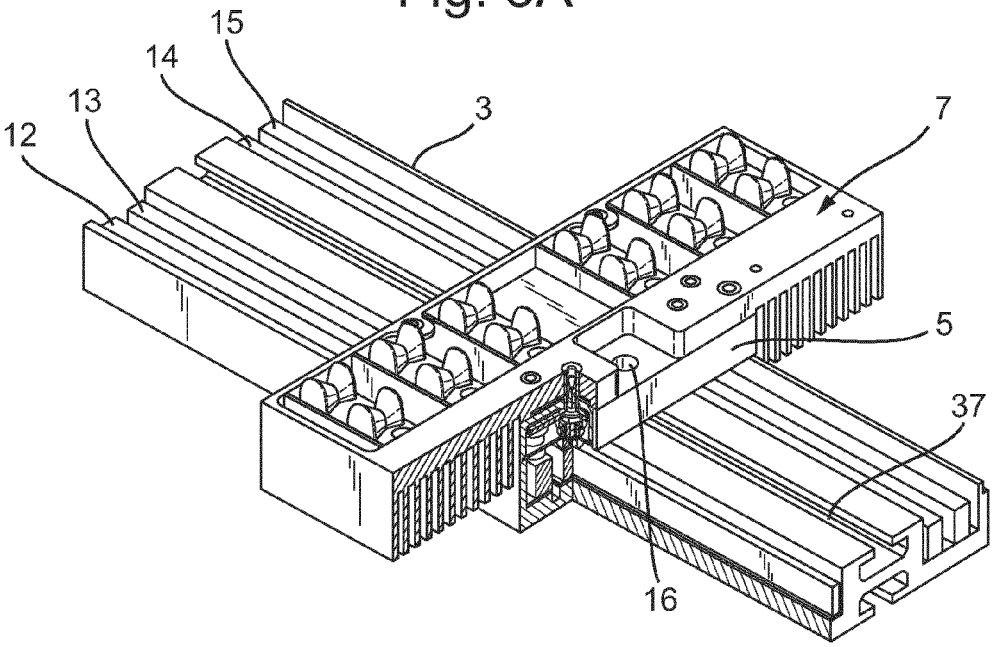
FIG. 3A illustrates a connection between the lighting module and a suspension rail in bottom view, part of which is cut away.
Figure 3B:
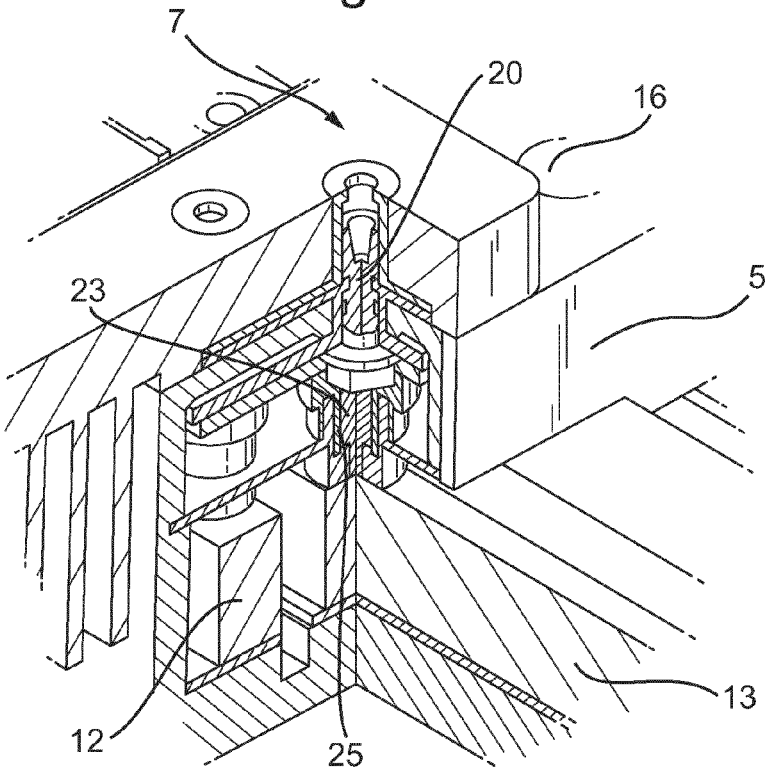
FIG. 3B illustrates a magnification of the cut away portion of FIG. 3A.

FIG. 3A provides a perspective bottom view of the connected lighting module 7, mounting member 5 and suspension rail 3 illustrated in FIG. 2. Part of the illustration is cut away such as to show the typical connection between a mounting electrode 23 and a conductor section 13 of the rail 3. An enlarged view of the cut away section B is illustrated in FIG. 3B.

Suspension rail 3 comprises a plurality of conductor sections 12, 13, 14 and 15. Mounting member 5 is connected first with a mechanical connection to the suspension rail 3 by using a leg bolt through opening 16 into slot 37 of the rail 3. Next, an electrical connection between the conductor sections 12, 13, 14 and 15 of the rail 3 and the mounting member 5 is made by forcing the pointed tips of the mounting electrodes of the mounting member 5 into the respective conductor sections 12-15. For mounting electrode 23, this is made visible in the cut away view in FIG. 3*a*. The cut away portion B is enlarged in FIG. 3B. Mounting electrode 23 is forced into conductor section 13 by means of a screwable clamping pin 20 of the lighting module 7. The clamping pin 20 and the mounting electrode 23 cooperate such as to enable forcing of the pointed tip of mounting electrode 23 into conductor section 13. Corresponding mounting electrodes are present in the mounting member 5 for connecting to the respective conductor sections 12, 14 and 15 as well. These, in turn, cooperate with corresponding clamping pins in the lighting module 7. By forcing the pointed tip of mounting electrode 23 into the anodized aluminum conductor section 13, the tip is forced through the anodized layer enabling the electrical connection. This is illustrated in FIG. 12.

Figure 12:
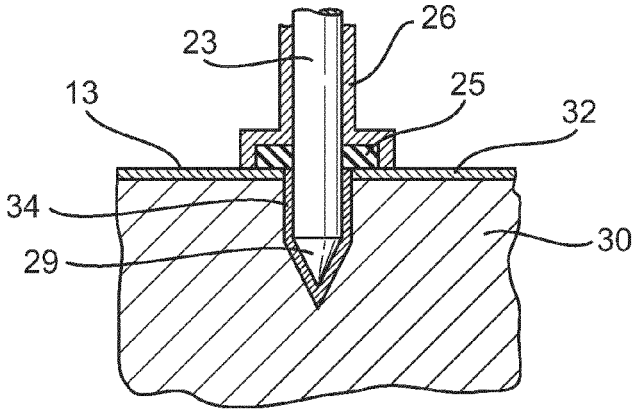
FIG. 12 schematically illustrates a connection between a mounting electrode of a mounting member and a conductor section of a suspension rail in a system in accordance with the present invention.

FIG. 12 illustrates the mounting electrode 23 of which the pointed tip 29 is forced into the aluminum 30 of which the conductor section 13 is made. Conductor section 13 is made of anodized aluminum, which comprises a passive surface layer 32 as illustrated in FIG. 12. The surface layer 32 is electrically insulating and also protects the interior aluminum 30 of the conductor section 13 against oxidizing. The pointed tip 29 of mounting electrode 23 is forced through the surface layer 32 into the aluminum 30 providing an electrical connection schematically illustrated by interface 34 in FIG. 12. To prevent oxidizing of the aluminum 30 at the interface 34 over time, the mounting electrode 23 moves inside a sleeve 26 (e.g. a metal sleeve). The sleeve 26 on one end provides room for a flexible seal 25 which is arranged therein. The flexible seal 25 is circumferential to the mounting electrode 23, and once the mounting electrode 23 is forced into the aluminum 30, the flexible seal 25 is slightly compressed against the sleeve 26, the electrode 23 and the surface layer 32. This prevents a direct connection between the electrical interface 34 and the exterior environment. Because the modular lighting, detection and control system 1 of the present invention may often be used in humid environments, application of the seal 25 for sealing the electrical connection 34 is preferred to prevent oxidizing of the aluminum 30. As will be appreciated, without the seal, oxidized aluminum may overtime deteriorate the electrical connection through interface 34, increasing its electrical resistance. This may prevent proper reception of the data signals and power signals by the lighting module 7 through the mounting member 5.

Figure 4:
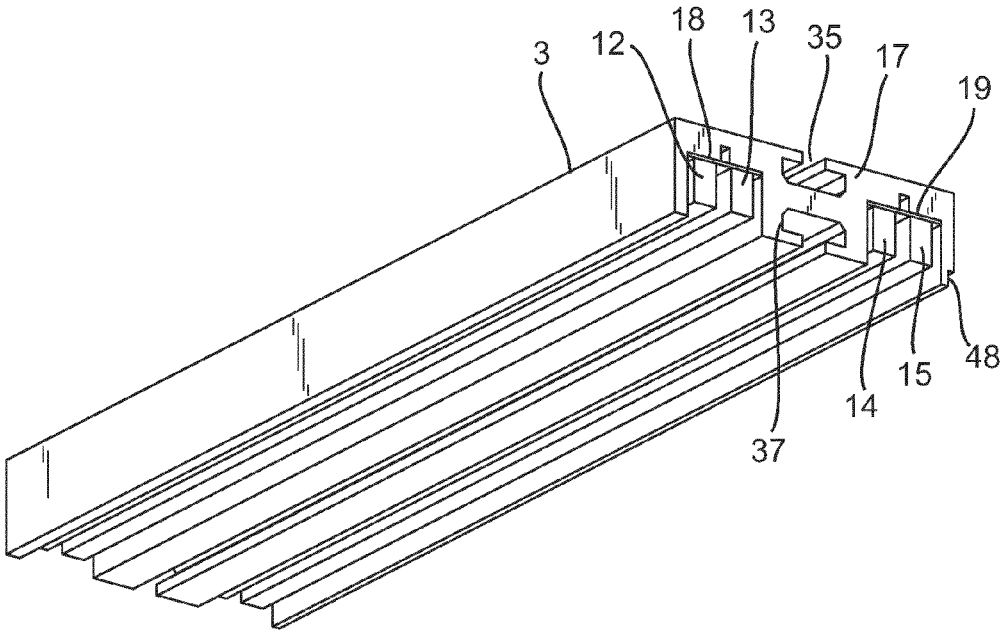
FIG. 4 illustrates a suspension rail of a system of the present invention.

FIG. 4 provides a perspective view of a suspension rail for use in a modular lighting, detection and control system 1 of the present invention. The rail 3 comprises the conductor sections 12, 13, 14 and 15. Between the conductor sections 12-15 and the body 17 of the rail, insulating layers 18 and 19 prevent short circuit and interference between the various electrical signals conveyed by the conductor sections 12-15 via the body 17. Preferably, not only the conductor sections 12-15 but also the body 17 of the suspension rail 3 is made of aluminum, for example anodized aluminum. As mentioned hereinabove, this will render the rail 3 to be relatively low weight. The body 17 of the rail 3 further comprises a slot 35 for fixing the rail 3 to a ceiling or wall of the construction wherein the system will be applied. A further slot 37 allows to provide a mechanical connection using a leg bolt with the mounting member, e.g. through opening 16 in the mounting member. FIG. 4 also reveals that the suspension rail 3 is provided on one side with a suitably shaped edge 48 serving as reverse protection to the system. The edge 48 corresponds with another edge 49 serving as reverse protection on the mounting member (illustrated in FIGS. 5A and 5B). The edge 48 and the corresponding edge 49 respectively on the suspension rails 3 and the mounting member 5, are also illustrated in FIG. 2. The edge serving as reverse protection, prevents a user from mounting the mounting member 5 such that the mounting electrode that receives the direct current power signal in use, would be connected incorrectly such as to damage the system module that is connected to the mounting member 5 of the system 1. The reverse protection formed by edges 48 and 49 only allows the mounting member to be connected to the suspension rail in the correct orientation relative thereto.

Figure 5A:
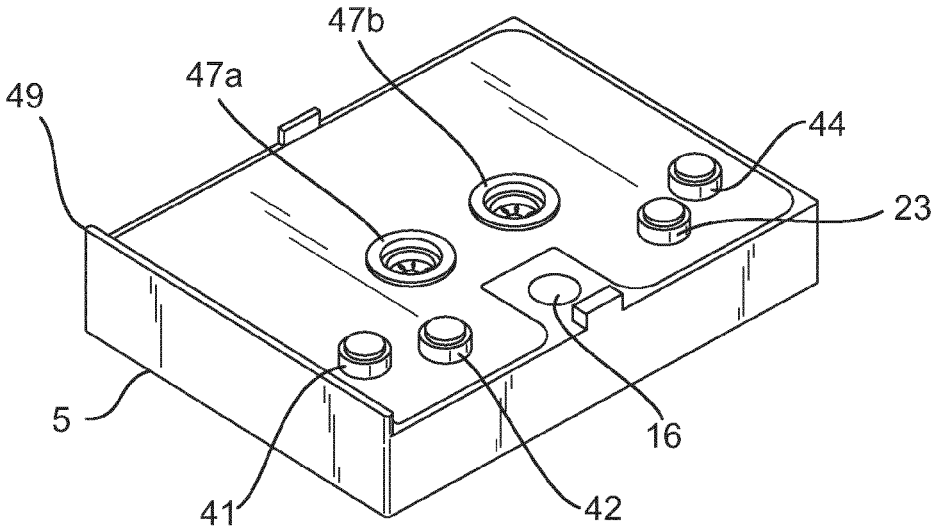
FIGS. 5A and 5B respectively illustrate a top and bottom view of a mounting member for use in a system in accordance with the present invention.
Figure 5B:
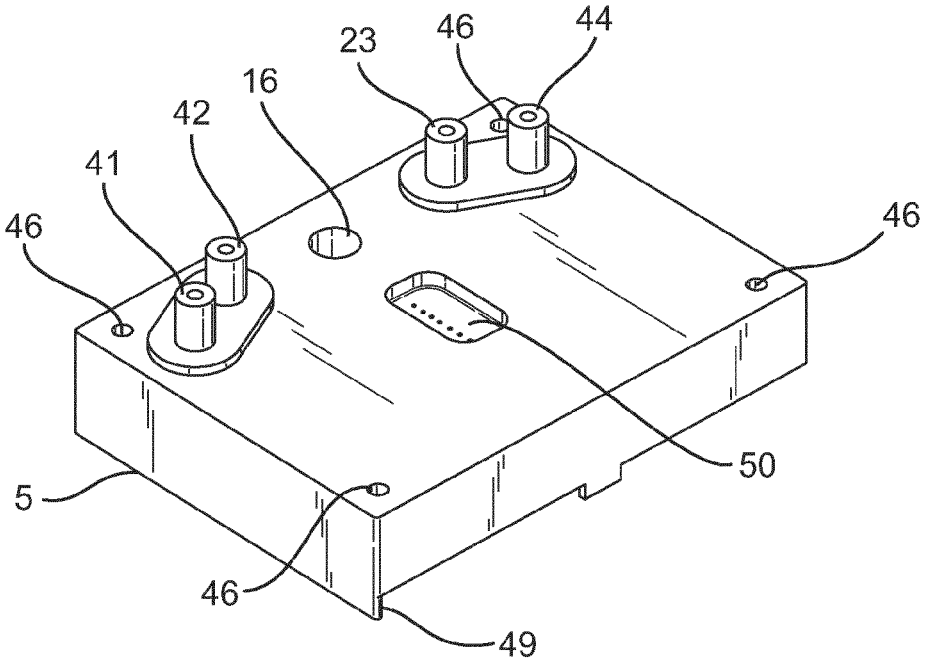

FIGS. 5A and 5B respectively illustrate a top and bottom view of a mounting member 5. In addition to mounting electrode 23, the mounting member 5 comprises further mounting electrodes 41, 42 and 44. Moreover, address selection such as 47*a* and 47*b* may optionally be present such as to allow addressability of each of the system modules via a mounting member 5. The address selection provided by optional switches 47*a* and 47*b* allows to target a data signal to specific system modules such as to control such modules.

As seen in FIG. 5B, the mounting member 5 further comprises module reception holes 46. The module reception holes 46 correspond with mounting pins 62 on the system modules (e.g. see FIG. 7A) enabling convenient installation. Also visible in FIG. 5B is input/output connector 50 which corresponds with a complementary input/output connector 8 on the modules such as to exchange the respective electrical signals with the system modules (i.e. the power signal and data signals).

Figure 6:
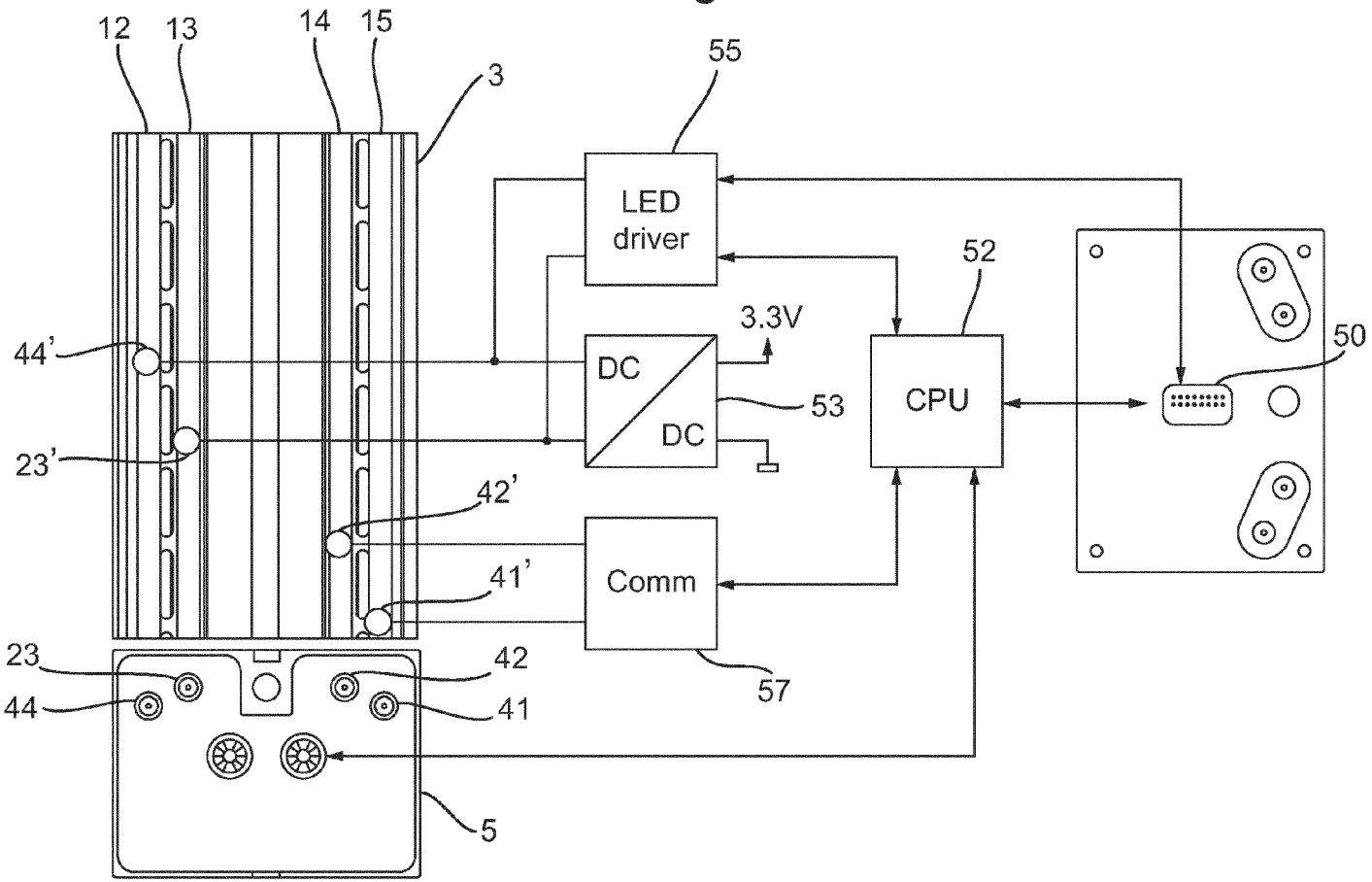
FIG. 6 provides a schematic illustration of the various parts of the mounting member of FIGS. 5A and 5B.

FIG. 6 illustrates schematically the various electronic components that may be present inside mounting member 5. Also visible in FIG. 6 is a bottom view of suspension rail 3, showing conductor sections 12, 13, 14 and 15. On mounting member 5, mounting electrode 41 connects with conductor section 15 on suspension rail 3. This is schematically indicated by dot 41'. Correspondingly, mounting electrode 42 connects to conductor section 14 as indicated schematically by dot 42'. Mounting electrode 23 connects with conductor section 13 as indicated by dot 23', and mounting electrode 44 connects to conductor section 12 as indicated schematically by dot 44'. The mounting member 5 comprises a central processing unit (CPU) 52. The mounting member 5 further comprises a DC power adaptor 53 receiving the direct current input power from the conductor sections 12 and 13. Connected thereto is a LED driver 45 which uses the received power signal for driving the light emitting diodes of the lighting module. The LED's of the lighting module (not shown) may be operated by means of the CPU 52 which connects to the LED driver. The driving signals for operating the LED's are provided, together with the power signal, via input/output connector 50 to the corresponding connector 8 of the lighting module 7. The CPU 52 is controlled by receiving data signals via the conductor sections 14 and 15 through a communications module (Comm).

Figure 7A:
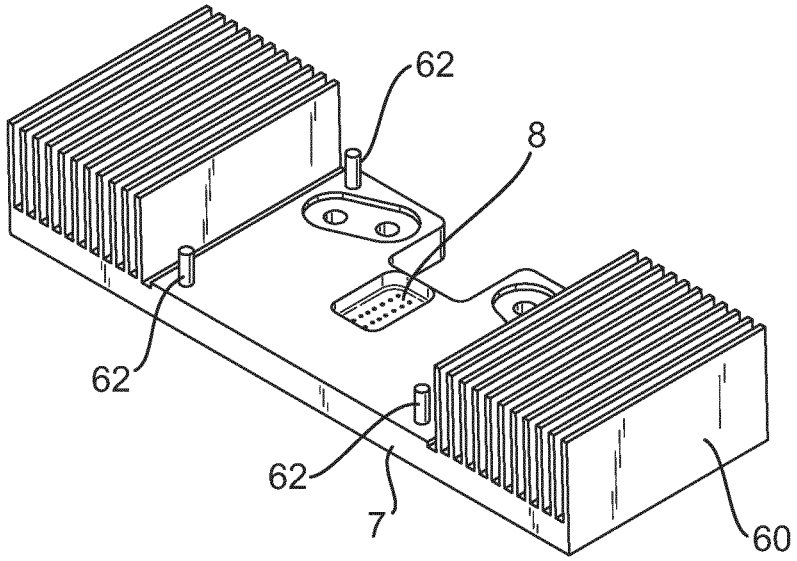
FIGS. 7A and 7B respectively illustrate a top and bottom view of a lighting module of a system of the present invention.
Figure 7B:
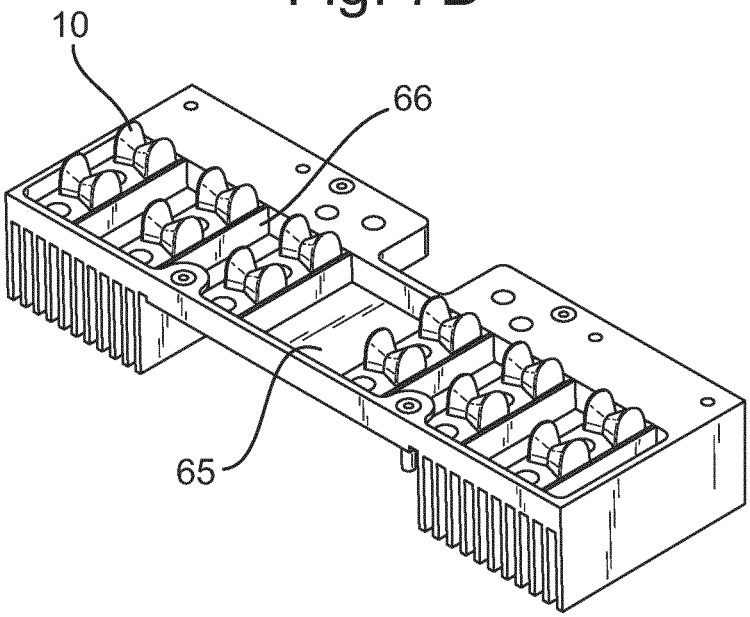

FIGS. 7A and 7B respectively illustrate a top and bottom view of a lighting module 7. The lighting module 7 is one of the system modules of a modular lighting, detection and control system of the present invention. The lighting module 7 comprises mounting pins 62 that correspond with the reception holes 46 of the mounting member 5. Also visible in FIG. 7A is the input/output connector 8 of the lighting module. Cooling ribs 60 for the LED's extend to the side of the lighting module relative to the suspension rail. Light of each of the lenses is correctly distributed by means of lenses 10 (which are also visible in FIG. 2). The electronics required to support operation of the LED's is integrated in the lighting module 7 by means of printed circuit board (PCB) 65 and 66. The lighting module 7 may be made of aluminum, e.g. by means of extrusion. In the embodiment illustrated in FIG. 7, the lighting module 7 comprises twelve LED's. Dependent on the requirements, the number of LED's may be larger or smaller.

Figure 8:
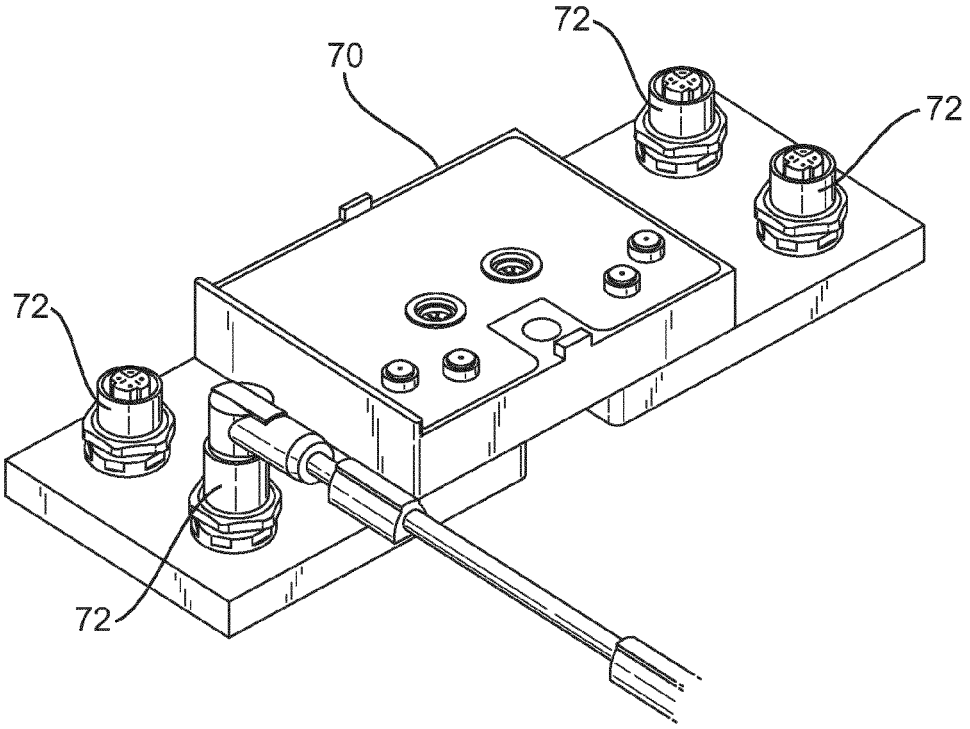
FIG. 8 illustrates a control module for use in the system of the present invention.

FIG. 8 illustrates a control module for use in a modular lighting control system of the present invention. The control module serves as an intermediate between the central server system (e.g. server 125 in FIG. 10) and the various system modules integrated in the modular lighting, detection and control system. The control module 70 enables to control the different system modules by the server. The embodiment shown in FIG. 8 typically illustrates a control module based on an EtherCAT protocol. A control module 7 comprises a number of four pole M12 connectors 72 for data exchange. The number of connectors 72 may be larger or smaller depending on the requirement, and depending on the protocol used. Alternative embodiments of a control module as illustrated in FIG. 8 may be based on different protocols, such as Profinet, and may require less connections.

Figure 9A:
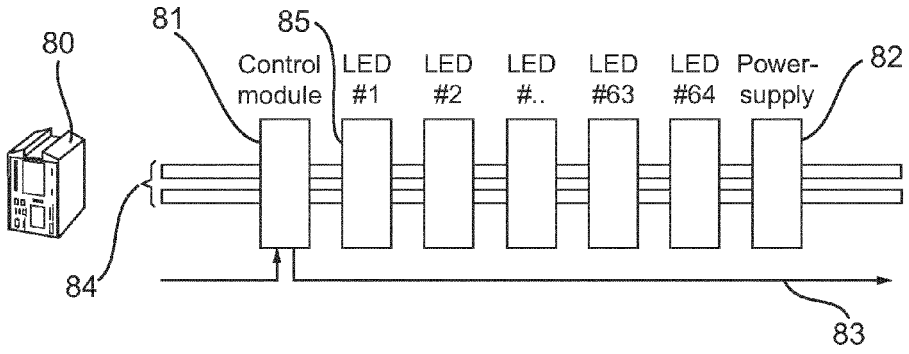
FIGS. 9A, 9B and 9C illustrate various levels of redundancy of the control module in system arrangements in accordance with the present invention.
Figure 9B:
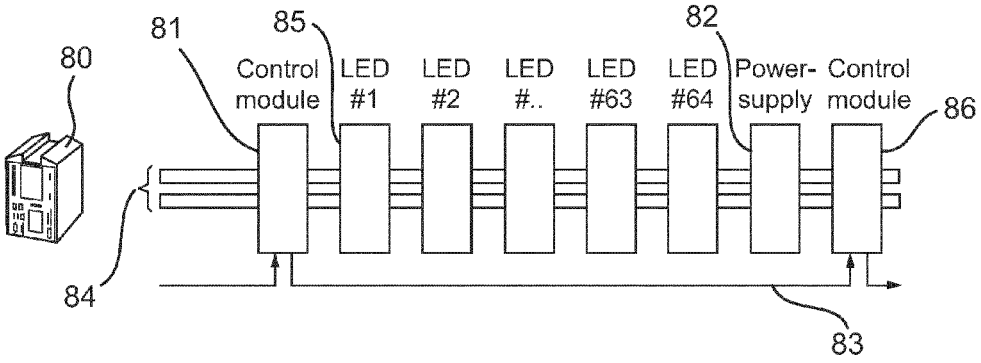
Figure 9C:
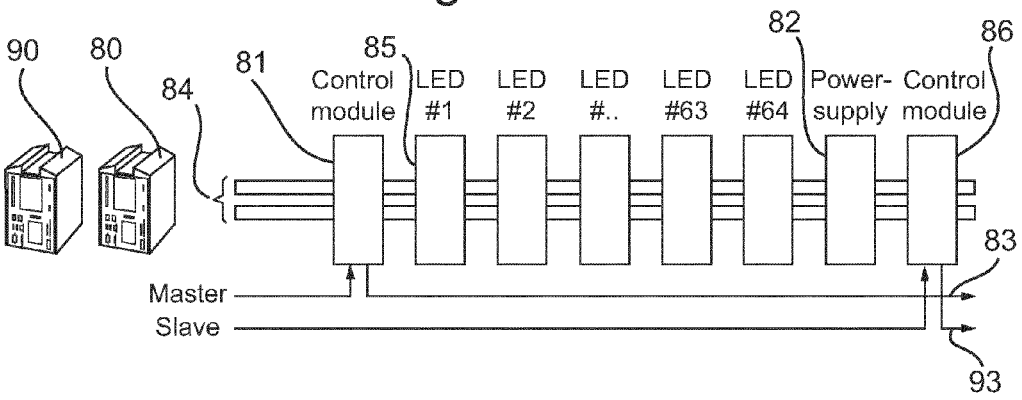

FIGS. 9A, 9B and 9C schematically illustrate various levels of redundancy in the control module. In a non-redundant implementation as illustrated in FIG. 9A, a server 80 may control a single control module 81. The control module 81 made by itself control a maximum total of 64 lighting units 85 (the number being dependent on the addressing scheme applied). Power of the system is supplied by power supply unit 82. The suspension rail is schematically illustrated by the double black line 84.

FIG. 9B illustrates a semi-redundant implementation. In the implementation illustrated in FIG. 9B, a single server 80 connects via a single data loop connection 83 with two control modules 81 and 86 present on the suspension rails 84. If one of the control modules fails, the other control module still allows operation of the lighting modules 85.

A full redundant implementation is illustrated in FIG. 9C. The full redundant implementation comprises two servers 80 and 90. Server 80 is the master server which connects to master data loop 83. Server 90 is the slave server which connects to slave data loop 93. A first control module 81 connects to master data loop 83 and may be operated by server 80. A second control module 86 connects to slave data loop 93 and can be operated by server 90. If one of the control modules 81 or 86, or one of the data loops 83 or 93, or one of the servers 80 or 90 fails, the system may still be fully operational as a result of the redundancy.

Figure 10:
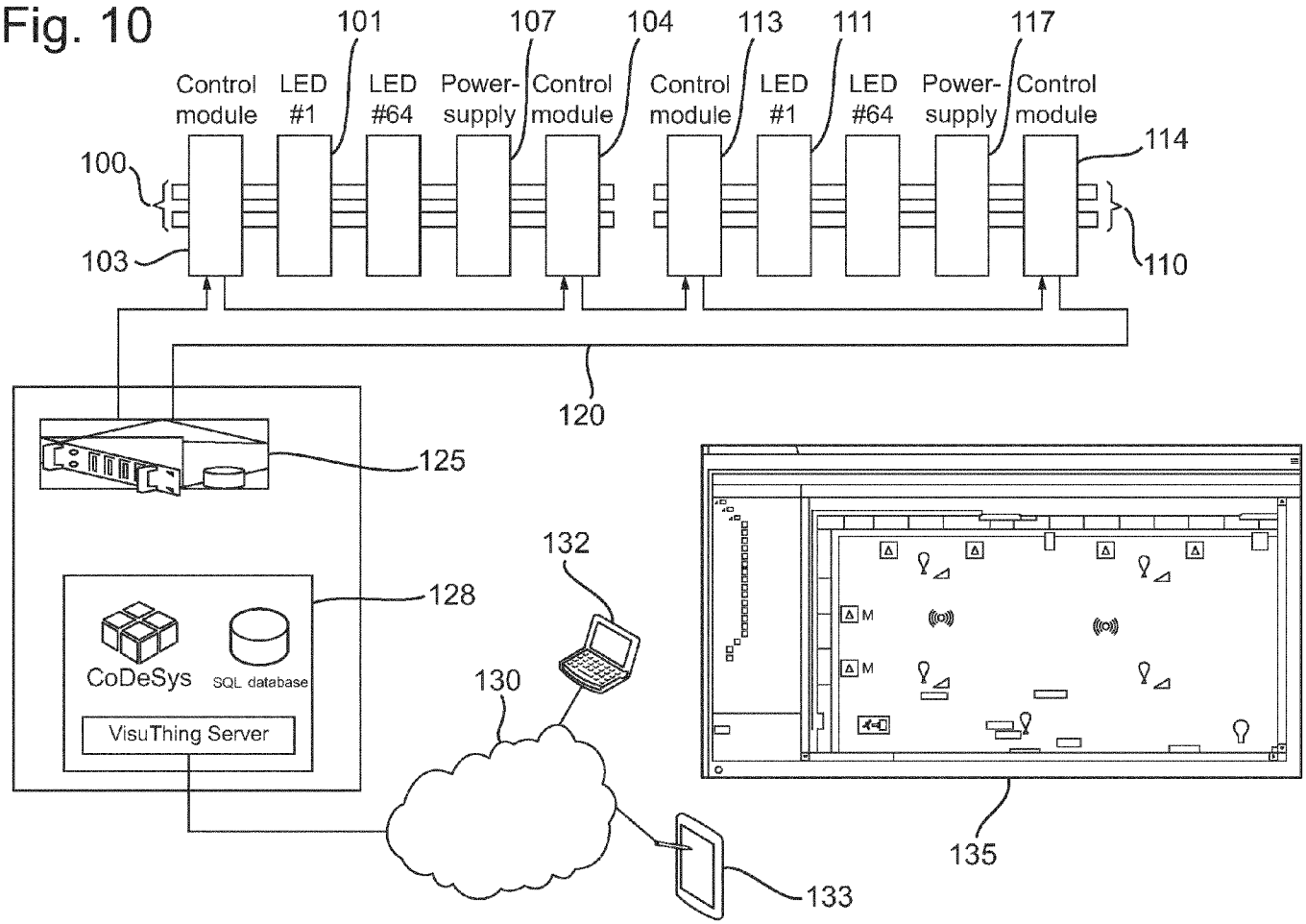
FIG. 10 schematically illustrates a system in accordance with the present invention.

FIG. 10 illustrates schematically a modular lighting, detection and control system of the present invention. In FIG. 10, a suspension rails 100 may be fixed to the ceiling or walls of for example a parking garage or a tunnel. A suspension rails 100 enable to suspend a number of system modules such as lighting modules 101 and 111 to the various rails 100 and 110. The lighting modules on the rails 100 can be operated by means of control module 103 and redundant control module 104. Rails 100 comprise a power supply 107 enabling powering of the 64 lighting modules 101. In addition, the rails 110 enable to suspend in total 64 lighting modules 111 thereto. These lighting modules 111 are powered by power supply 117. Moreover, control units 113 and 114 redundantly control operation of the lighting modules 111 on rail 110. The schematic illustration provided in FIG. 10 typically shows a semi-redundant control scheme for controlling the lighting modules (compare FIG. 10 to FIG. 9B). Data to the various control modules is provided via data loop 120. As may be appreciated, although a single data loop 120 is illustrated in FIG. 10, multiple data loops may be implemented such as to serve each of the suspension rails 100 and 110 in a semi-redundant manner. The control units 103, 104, 113 and 114 are operated by means of a central server 125. The central server 125 runs a management software program 128 allowing to control the modular lighting, detection and control system of the present invention. The standard server 125 may be connected to the internet 130 such as to allow to control the standard server remotely by means of for example a laptop 132 or a tablet type or other portable computer 133. In FIG. 10, an example of a typical graphical user interface (GUI) 135 is illustrated.

Figure 11:
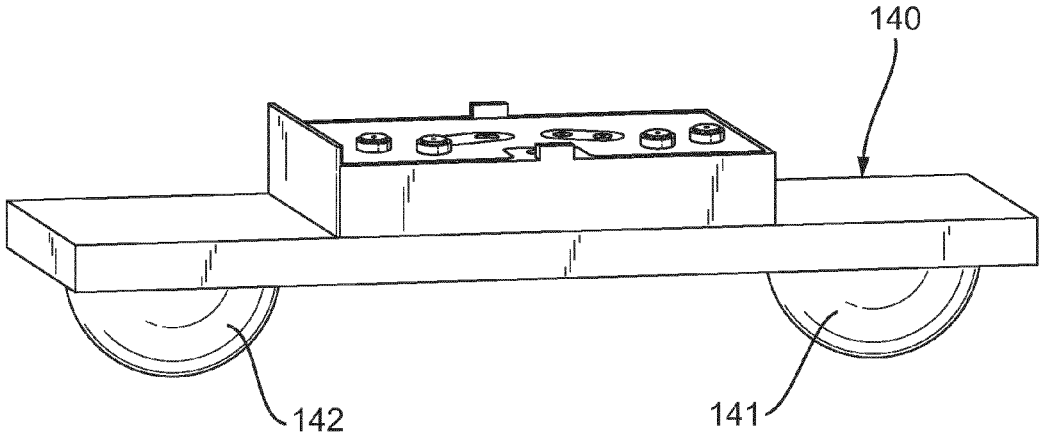
FIG. 11 illustrates a vehicle detection module for use in a system of the present invention.

FIG. 11 further illustrates a different type of system module that may be applied for example in a parking garage. The module 140 illustrated in FIG. 11 is a vehicle detection module that allows to detect whether a specific parking space in a parking garage is occupied or not. To indicate this, the module 140 comprises a green light 141 and a red light 142. In case the parking space is unoccupied, this is indicated by means of the green light 141.

Figure 13A:
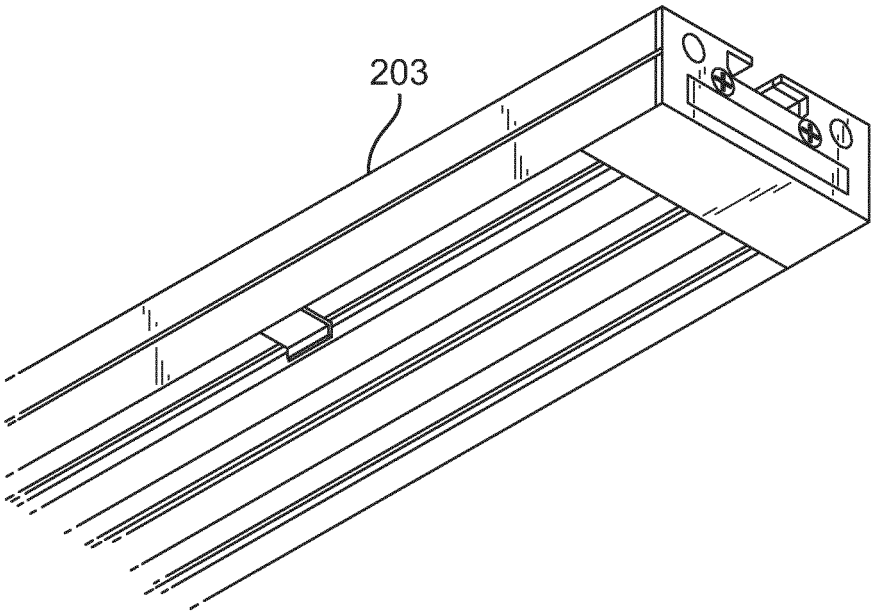
FIGS. 13A and 13B illustrate a suspension rail in accordance with a further embodiment of the present invention.
Figure 13B:
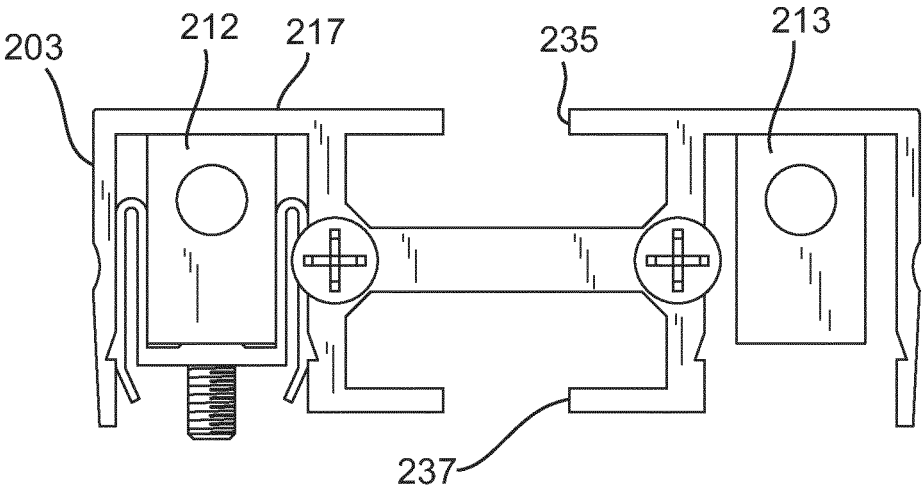

A further embodiment of a modular lighting, detection and control system 201 in accordance with the present invention is illustrated in FIGS. 13-15. FIGS. 13A and 13B illustrate a suspension rail 203 for use in this further embodiment of the present invention. In FIG. 13B, the suspension rail 203 is illustrated in cross section. Suspension rail 203 comprises conductor sections 212 and 213. The conductor sections 212 and 213 are arranged for providing the power signal (i.e. a low voltage electrical power signal) to the modules of the modular lighting, detection and control system. In the present embodiment, the suspension rail 203 does not comprise conductor sections for providing a data signal to the respective modules. The rail 203 can be used in a relatively plain embodiment wherein no data signal is provided to the respective modules. For example, such an embodiment would be suitable for simply providing lighting only, wherein the power supply to the lighting modules may be controlled either for the whole system or the rail by a separate controller. Switching the lighting modules on and off may for example be controlled by switching the power signal on and off by a controller.

The suspension rail 203 with the conductor sections 212 and 213 may alternatively be used in a system wherein data is provided to the respective modules via power line communication. In such an alternative embodiment, the data signal is super-imposed over the power signal and is conveyed via the conductor sections 212 and 213 to the respective modules. The respective modules may in that case be arranged for separating the data signal from the power signal for internal use.

The conductor rail 203 further comprises a body 217 to which the conductor sections 212 and 213 are fixed. Slot 235 allows to fix the body 217 to the ceiling or a wall of the construction wherein the system will be applied. A further slot 237 allows to provide a mechanical connection, using for example a leg bolt, with the respective modules of the system.

Figure 14A:
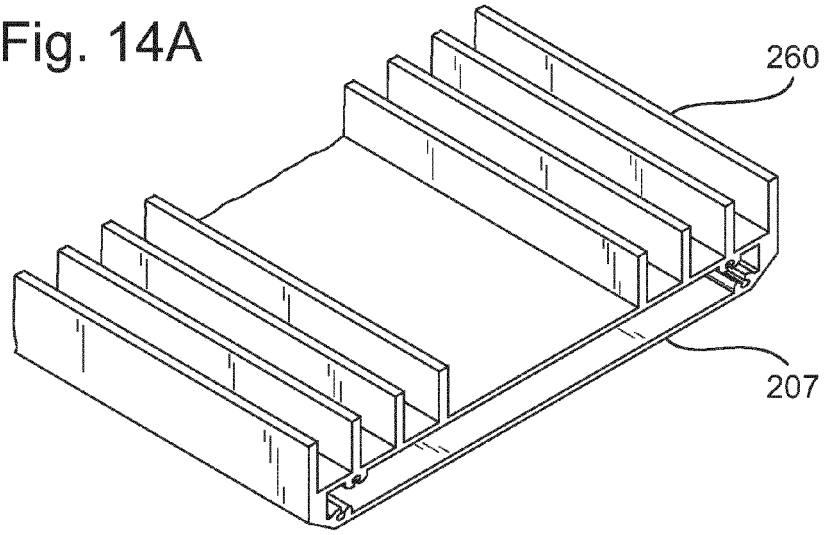
FIGS. 14A, 14B and 14C illustrate a lighting module for use with the suspension rail illustrated in FIGS. 13A and 13B.
Figure 14B:
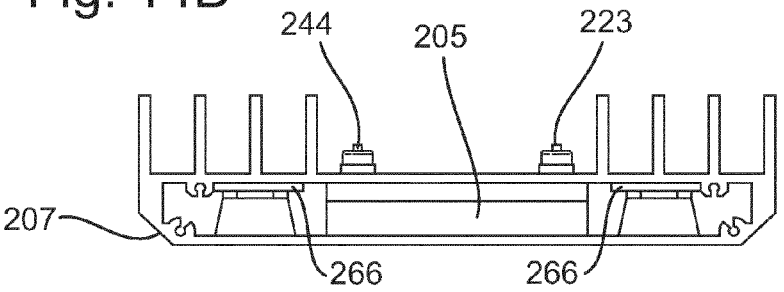
Figure 14C:
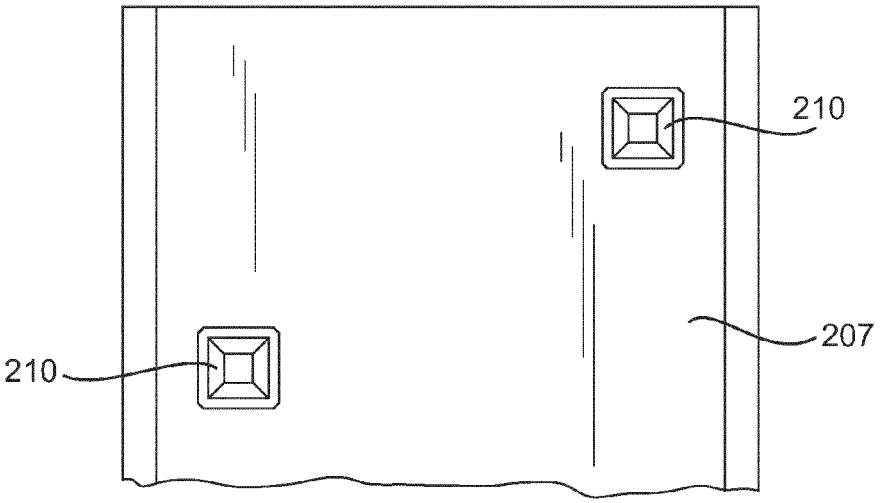

A typical lighting module 207 for use in a modular lighting, detection and control system 201 in accordance with this embodiment is illustrated in FIGS. 14A, 14B and 14C. The lighting module 207 comprises an integrated mounting member 205 which allows to fix the lighting module 207 to the suspension rail 203. Integration of the mounting member 205 into the lighting module 207 has several advantages. For example, for installing a lighting module 207 on the suspension rail 203, it is not necessary to first install the mounting member, thereby providing a more easy installation of the modular lighting, detection and control system in accordance with this embodiment. However a major advantage is provided by the fact that integrating the mounting member 205 into the lighting module 207 allows to provide a very flat construction. Measured from the body of the suspension rail where it is mounted to the wall or ceiling, the thickness of the system including the lighting module 207 could be typically 30 mm (or even smaller if desired).

As can be seen in FIG. 14A, the lighting module 207 comprises a plurality of cooling ribs 260. Moreover, as visible in FIG. 14B, the lighting module 207 comprises mounting electrodes 223 and 244. Mounting electrode 223 will be mounted onto conductor section 213 of suspension rail 203, where is mounting electrode 244 will be mounted onto conductor section 212 of suspension rail 203. Printed circuit boards 266 are arranged within the lighting module 207 contiguous to the light emitting diodes 210, as illustrated in FIGS. 14B and 14C.

Figure 15A:
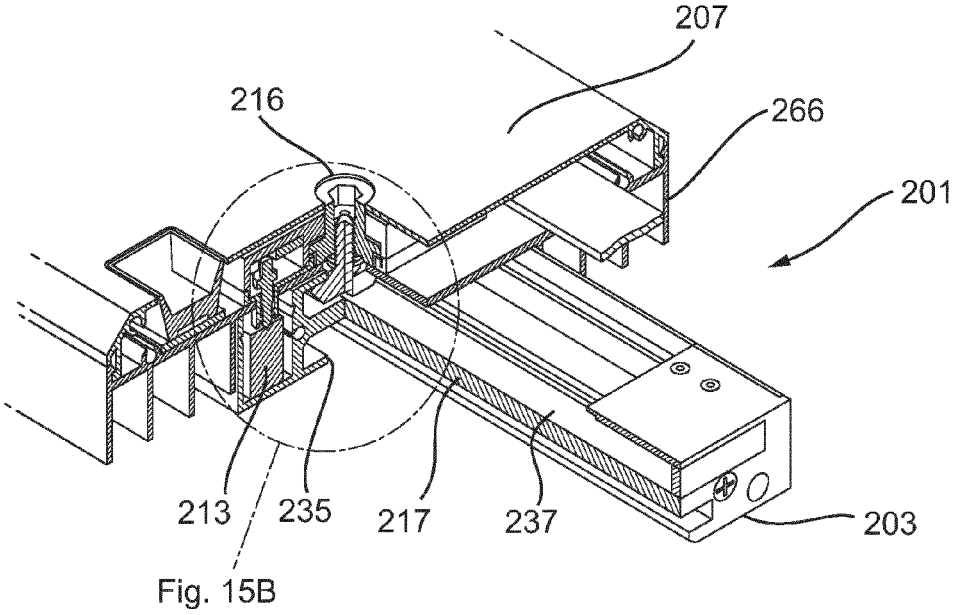
FIGS. 15A and 15B illustrate a connection between the lighting module of FIGS. 14A-C and a suspension rail of FIGS. 13A and 13B, part of which is cut away.
Figure 15B:
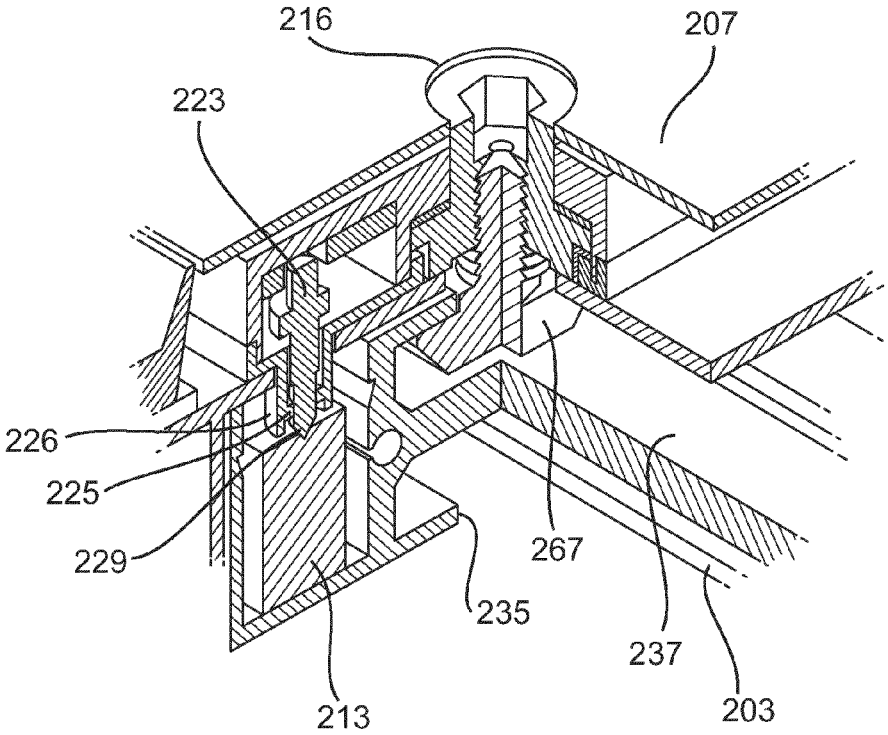

FIGS. 15A and 15B provide a perspective view of the connected lighting module 207 and suspension rail 203 described above. The suspension rail 203 and lighting module 207 are part of a modular lighting, detection and control system 201 in accordance with this embodiment. Visible in FIG. 15A is the suspension rail in 203 comprising a body 217. Further visible in FIG. 15A is the lighting module 207. Part of the FIG. 15A is cut away (illustrated by section G), and an enlarged view of the cut away section is illustrated in FIG. 15B.

Visible in FIGS. 15A and 15B is the slot 235 in suspension rail 203 for fixing the suspension rail 203 to a wall or ceiling. Also visible in FIGS. 15A and 15B is the further slot 237 which allows to provide a mechanical connection between the lighting module 207 and the suspension rail 203 by means of a leg bolt 267. The leg bolt 267 is accessible via opening 216 in the lighting module 207. In the lighting module illustrated in FIGS. 14A-C, as can be seen in FIG. 15B, the mounting electrodes 223 and 244 are fixed within the construction of the lighting module 207. Forcing the pointed tips of the mounting electrodes 223 and 244 (e.g. pointed tip 229 of mounting electrode 223) into the respective conductor sections (e.g. 213) is achieved by fixing the lighting module 207 to the suspension rail 203 by means of the leg bolt 267. By fastening the leg bolt 267, the force exerted on the mounting electrodes 223 and 244 will drive the pointed tips (e.g. 229) into the suspension rails (e.g. suspension rail 213). This will provide a conductive connection such as illustrated in FIG. 12 between the mounting electrode and respective conductor section. Also visible in FIG. 15B are the sleeve 226 of the electrode 223 and the flexible seal 225 surrounding the pointed tip 229. The seal 225 prevents the conductive connection from being exposed to the environment, as explained before.

For the purpose of clarity and a concise description features are described herein as part of the same or separate embodiments, however, it will be appreciated that the scope of the invention may include embodiments having combinations of all or some of the features described. The present invention has been described in terms of some specific embodiments thereof. It will be appreciated that the embodiments shown in the drawings and described herein are intended for illustrated purposes only and are not by any manner or means intended to be restrictive on the invention. The context of the invention discussed here is merely restricted by the scope of the appended claims.

The invention claimed is:

1. A modular lighting, detection and control system for indoor lighting applications comprising an assembly of one or more suspension rails and one or more system modules, wherein the suspension rails are arranged for receiving the system modules, and the system modules are arranged for mounting thereof on the suspension rails for suspending therefrom, and wherein the system is arranged conveying electric signals to and/or from the system modules via the suspension rails, said electric signals including a power signal for powering the system modules, wherein the system further comprises a low voltage power supply unit for providing the power signal, the power signal being a low voltage electrical power signal, and wherein for conveying the electric signals the suspension rails comprise one or more conductor sections, wherein the conductor sections are formed of a conductive material substantially comprising aluminum; and wherein the conductive material comprises a surface layer of anodized aluminum.

2. The modular lighting, detection and control system according to claim 1, wherein at least one of said suspension rails is formed of the conductive material comprising aluminum, and wherein the conductor sections of the at least one suspension rail include at least one conductor section which is integrally formed with the suspension rail.

3. The modular lighting, detection and control system according to claim 1, wherein for mounting thereof on at least one of the suspension rails, at least one of the system modules includes a mounting electrode, said mounting electrode being formed of a conductive material and including a pointed tip for forcing said pointed tip through the layer of anodized aluminum to establish a conductive connection with at least one of said conductor sections of the rail.

4. The modular lighting, detection and control system according to claim 3, wherein the mounting electrode further includes a seal for sealing the conductive connection established between the pointed tip and the conductor section.

5. The modular lighting, detection and control system according to claim 4, wherein the seal comprises a flexible seal for surrounding the pointed tip.

6. The modular lighting, detection and control system according to claim 3, wherein the mounting electrode cooperates with a mounting member of the system module, and wherein for forcing the pointed tip through the anodized layer the mounting electrode comprises at least one of a group comprising: a screw for screwing the mounting electrode with the pointed tip into the anodized layer; a pin cooperating with a spring for forcing the tip through the anodized layer by spring force of the spring, and a pin cooperating with a clamp mechanism on the mounting member.

7. The modular lighting, detection and control system according to claim 1, wherein one or more of the suspension rails comprise multiple conductor sections, which conductor sections are electrically insulated from each other for conveying one or more of said electric signals separate from each other.

8. The modular lighting, detection and control system according to claim 7, wherein said electric signals further include one or more electric data signals to or from at least one of the system modules, the one or more suspension rails comprising power signal conductor sections for conveying said power signals, and data signal conductor sections for conveying said data signals.

9. The modular lighting, detection and control system according to claim 1, wherein said electric signals further include one or more electric data signals to or from at least one of the system modules, wherein the system is arranged for conveying said power signals and data signals over the same conductor sections.

10. The modular lighting, detection and control system according to claim 1, wherein said electric signals further include one or more electric data signals to or from at least one of the system modules, the system further comprising a data communication module for providing and/or receiving the electric data signals, the data communication module being arranged for supporting at least one data communication protocol of a group comprising: a fieldbus type protocol, a power line communication type protocol, and digital addressable lighting interface DALI.

11. The modular lighting, detection and control system according to claim 1, the system modules including one or more of a group comprising: a lighting module comprising a lighting unit, a control module for controlling one or more other system modules, an object detection module, and a motion detection module.

12. A suspension rail for use in a modular lighting, detection and control system in accordance with claim 1, the suspension rail being arranged for receiving system modules in use suspending therefrom, the rail comprising one or more conductor sections, wherein the conductor sections are formed of a conductive material substantially comprising aluminum; and wherein the rail and the conductor sections are formed of anodized aluminum.

13. A system module for use in a modular lighting, detection and control system in accordance with claim 1, wherein the system module is arranged for mounting thereof on a suspension rail of the system for suspending therefrom, wherein for mounting thereof on at least one of the suspension rail the system module includes a mounting electrode, said mounting electrode being formed of a conductive material and including a pointed tip for forcing said pointed tip through the layer of anodized aluminum to establish a conductive connection with at least one of said conductor sections of the rail.

14. The system module according to claim 13, wherein the mounting electrode further includes a seal for sealing the conductive connection established between the pointed tip and the conductor section.

15. The system module according to claim 13, wherein the system module includes at least one of a group comprising: a lighting module comprising a lighting armature, a control module for controlling one or more other system modules; an object, condition or person detection module; and a motion detection module.

* * * * *